US008734132B2

(12) United States Patent
Brender a Brandis

(10) Patent No.: US 8,734,132 B2
(45) Date of Patent: May 27, 2014

(54) WATER PUMP FOR USE IN IRRIGATION AND FOR OTHER PURPOSES

(75) Inventor: Joost Brender a Brandis, Wilmington, NC (US)

(73) Assignee: The Full Belly Project Ltd., Wilmington, NC (US)

( * ) Notice: Subject to any disclaimer, the term of this patent is extended or adjusted under 35 U.S.C. 154(b) by 102 days.

(21) Appl. No.: 13/499,863

(22) PCT Filed: Oct. 19, 2009

(86) PCT No.: PCT/US2009/061122
§ 371 (c)(1),
(2), (4) Date: Apr. 2, 2012

(87) PCT Pub. No.: WO2011/049549
PCT Pub. Date: Apr. 28, 2011

(65) Prior Publication Data
US 2012/0195771 A1 Aug. 2, 2012

(51) Int. Cl.
*F04B 43/02* (2006.01)
*F04B 9/14* (2006.01)

(52) U.S. Cl.
USPC ..... 417/413.1; 417/374

(58) Field of Classification Search
CPC ..... F04B 45/043; F04B 45/04; F04B 43/02; F04B 43/026; F04B 43/025; F04B 9/14
USPC ..... 417/413.1, 374, 313
See application file for complete search history.

(56) References Cited

U.S. PATENT DOCUMENTS

| | | | | |
|---|---|---|---|---|
| 2,367,184 | A * | 1/1945 | Byroad | 417/244 |
| 4,124,334 | A * | 11/1978 | Mazzetti | 417/480 |
| 4,537,563 | A | 8/1985 | Ogawa | |
| 4,911,613 | A | 3/1990 | Cox | |
| 5,791,882 | A * | 8/1998 | Stucker et al. | 417/269 |
| 6,644,937 | B2 | 11/2003 | Han | |
| 7,887,304 | B2 * | 2/2011 | Cai et al. | 417/271 |
| 2006/0073036 | A1 * | 4/2006 | Pascual et al. | 417/413.1 |
| 2006/0216163 | A1 | 9/2006 | Park | |
| 2011/0097227 | A1 * | 4/2011 | Cai et al. | 417/472 |

OTHER PUBLICATIONS

Weisman, Alan, Gaviotas: A Village to Reinvent the World, Chelsea Green Publishing 1998.

* cited by examiner

*Primary Examiner* — Bryan Lettman
(74) *Attorney, Agent, or Firm* — Fried, Frank, Harris, Shriver & Jacobson LLP

(57) ABSTRACT

The present invention addresses the need for a water pump that may be constructed from inexpensive materials available even in impoverished areas. The pump uses a simple rocking motion to pump water and can pump significant amounts of water from sources that otherwise could not be reached. In a preferred embodiment, the pump comprises three concrete chambers, a pumping platform adapted to rock in a see-saw fashion, and a plurality of valves to control the flow of water. The first two chambers contain diaphragms that, as a result of rocking the pumping platform, draw liquid into the chambers and force liquid from those chambers into the third chamber. Two valves selectively permit liquid to be drawn into the first and second chambers, and prevent the liquid from exiting the chambers and returning to the source. Third and fourth valves allow liquid to flow from the first and second chambers into the third chamber, and prevent the liquid in the third chamber from flowing back into the first or second chambers.

15 Claims, 8 Drawing Sheets

WATER PUMP FOR USE IN IRRIGATION AND FOR OTHER PURPOSES

FIELD OF THE INVENTION

This invention relates generally to the field of pumps and, more specifically, is directed to a water pump that is easy to construct and may be built from inexpensive and commonly available materials.

BACKGROUND OF THE INVENTION

Farmers in developing nations and other impoverished areas often lack the financial resources to invest in technologies that simplify the farming process and make it more profitable. In particular, many such farmers do not have access to inexpensive yet effective irrigation and water pumping technologies.

One pump intended to address this issue is a foot-powered pump called the MoneyMaker manufactured by KickStart Technologies. This pump, however, requires users to employ a relatively taxing "step climber" motion to pump water in which the user stands and alternately presses down on a pair of pedals. Additionally, because the pump is made primarily of machined metal parts, it is relatively expensive and cannot be manufactured by farmers themselves. Also, since the pump is not manufactured from parts that are easily replicable or available to farmers, it is relatively difficult and expensive to repair the pump in the event of a malfunction or to replace worn out parts.

Accordingly, there continues to exist a need for an inexpensive water pump that is easy to construct form materials commonly available even in impoverished areas of the world.

SUMMARY OF THE INVENTION

The present invention addresses the above need and provides an easy to construct water pump that may be constructed from inexpensive materials available even in impoverished areas. The pump uses a simple rocking motion to draw and pump water that can be performed by almost any person from child to senior and can pump significant amounts of water per unit time from a given source. It can also make water available from sources that otherwise could not be reached because, e.g., of their depth below the ground surface.

In a preferred embodiment, the pump comprises three concrete chambers, a pumping platform adapted to rock in a see-saw fashion, and a plurality of valves to control the flow of water. The first two chambers contain diaphragms that, as a result of rocking the pumping platform, draw liquid into the chambers and force liquid from those chambers into the third chamber. Two valves selectively permit liquid to be drawn into the first and second chambers, and prevent the liquid from exiting the chambers and returning to the source. Third and fourth valves allow liquid to flow from the first and second chambers into the third chamber, and prevent the liquid in the third chamber from flowing back into the first or second chambers.

DETAILED DESCRIPTION OF THE PREFERRED EMBODIMENTS

Figure 1:
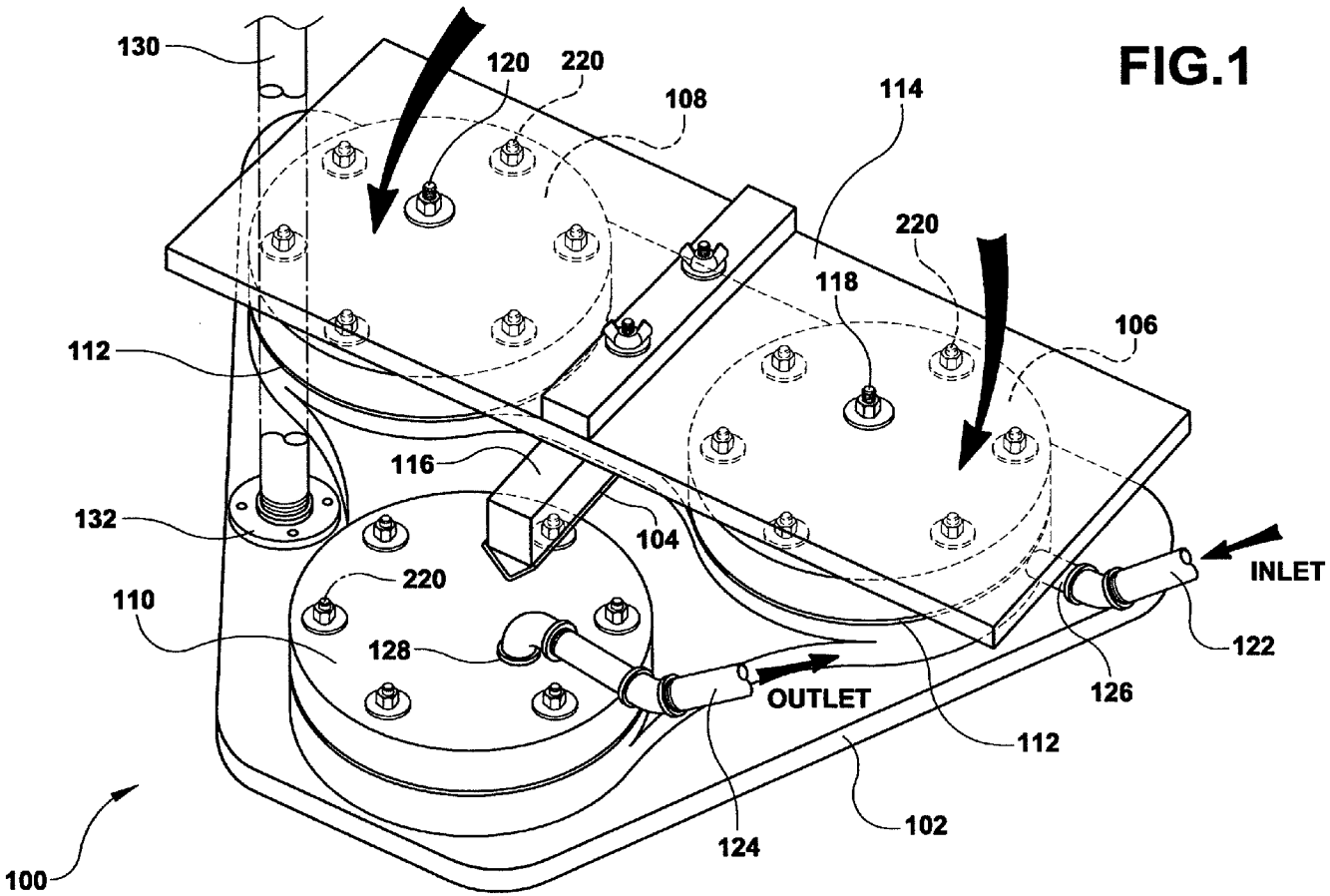
FIG. 1 is a perspective view of one preferred embodiment of the present invention.
Figure 2:
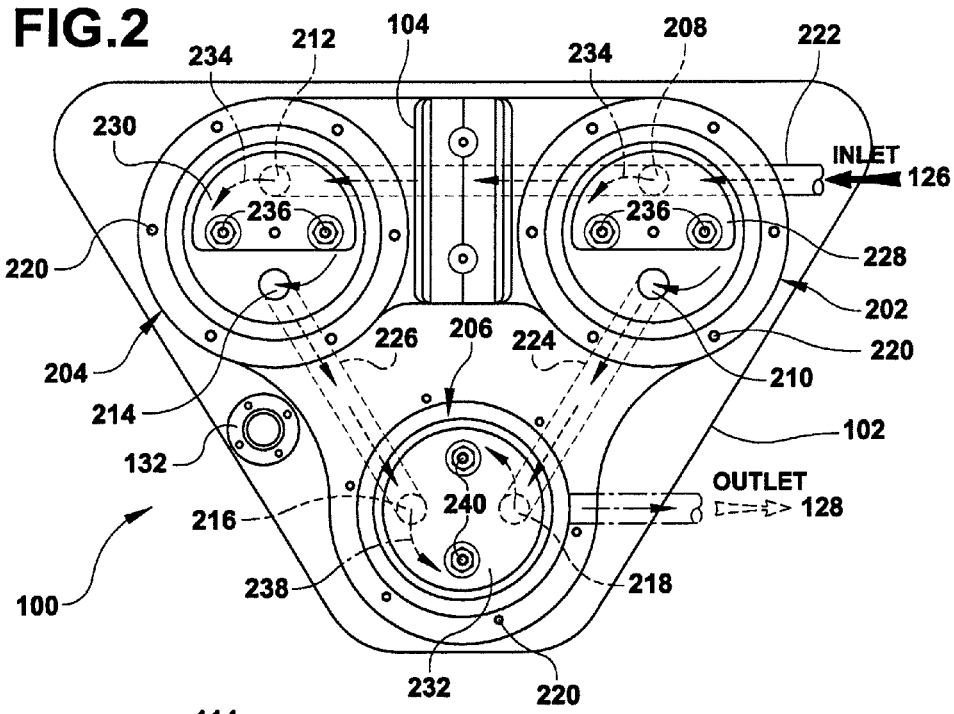
FIG. 2 is a top plan view of the preferred embodiment of FIG. 1 with the platform, upper cylinders, diaphragms and disks removed.
Figure 3:
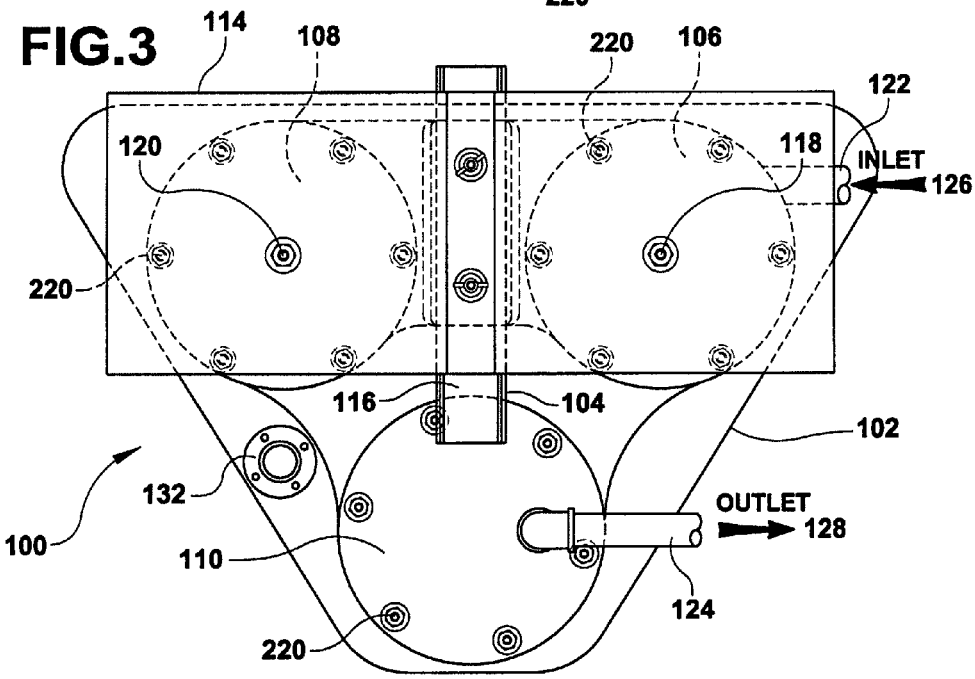
FIG. 3 is a top plan view of the preferred embodiment of FIG. 1.
Figure 4:
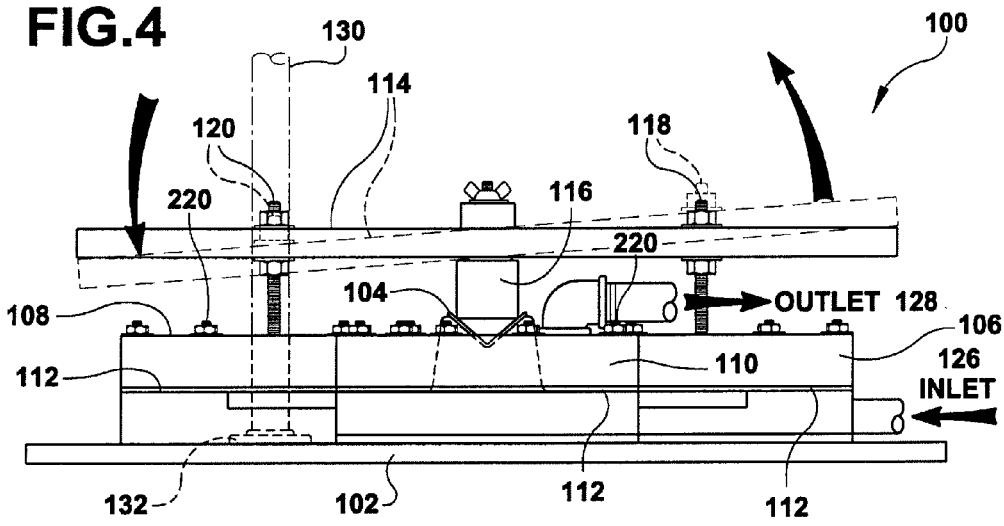
FIG. 4 is a front elevation view of the preferred embodiment of FIG. 1.
Figure 5:
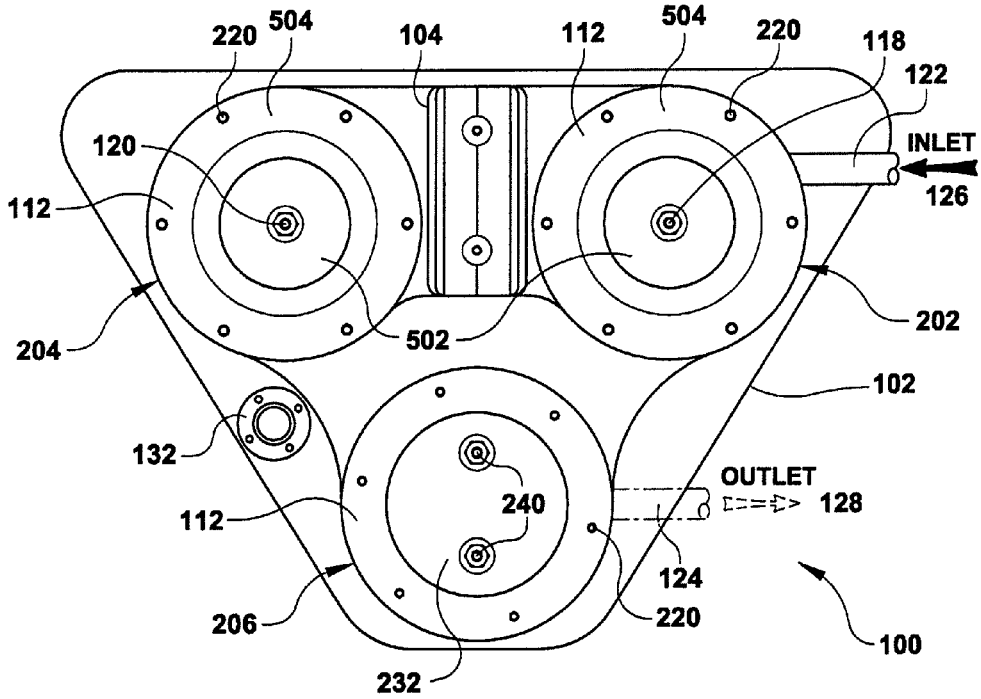
FIG. 5 is a top plan view of the preferred embodiment of FIG. 1 with the platform and upper cylinders removed.

A preferred embodiment of a pump constructed in accordance with the present invention is shown in FIGS. 1-5 and 8-9. As shown in FIG. 1, a pump 100 comprises a base 102 having a generally three-sided footprint. As best seen in FIG. 2, base 102 has formed therein a plurality of cavities 202-206. Cavities 202-204 may have a depth of approximately 1 inch, and a diameter of approximately 5.25 inches at the top of each cavity and tapering to approximately 5 inches at the bottom of each cavity. Cavity 206 may have a depth of approximately 0.25 inches, and a diameter of approximately 5.25 inches at the top of the cavity and tapering to approximately 5 inches at the bottom of the cavity. The height of base 102 may be approximately 2.5 inches.

The floor of each cavity 202-206 comprises two openings (208-210 in cavity 202; 212-214 in cavity 204; and 216-218 in cavity 206) each of which connects to a channel formed within base 102 and lined with PVC pipe, as described in more detail below. The shoulders of cavities 202-206 have embedded therein a plurality of securing bolts 220 with their threaded ends extending upward.

Returning to FIG. 1, pump 100 further comprises a plurality of cylinders 106-110 securely fastened to the concrete base 102 by securing bolts 220 by washers and nuts. A diaphragm assembly 112 is secured between concrete base 102 and cylinders 106-108, as described in more detail below. The overall length of bolts 220 may be approximately 3.5 inches for embodiments where the cylinders are concrete and approximately 1.5 inches for embodiments where the cylinders are made of PVC as in the embodiment shown in FIGS. 10-11 below. The bolt size or diameter of bolts 220 may be approximately ¼ inches or 6 millimeters.

Pump 100 further comprises a pumping platform 114 having a pivot 116 adapted to engage a depression in a fulcrum 104. Pumping platform 114 is connected to diaphragm assemblies 112 by driving rods 118-120 secured by washers and nuts. Driving rods 118-120 may be bolts having a length of approximately 10-11 inches and a bolt size or diameter of approximately ⅜ inches or 10 millimeters. A handle 130 attached to the base 102 by a bracket 132 may be provided to help a user maintain his or her balance while standing on the pumping platform.

Also shown in FIG. 1, are hoses 122, 124. A first end of hose 122 is preferably placed in contact with a source of water (or other liquid) to be pumped such as a stream, well, or lake (not shown). The second end of hose 122 attaches to an inlet 126 in concrete base 102.

Hose 124 is attached at one end to an outlet 128 in the top of cylinder 110. Water (or other liquid) pumped by pump 100 is delivered to hose 124 via outlet 128 and may then be further carried through hose 124 to any desired location within the hose's reach to provide water for drinking, irrigation, or any other purpose.

As noted, a plurality of channels that connect to openings 208-218 of cavities 202-206 are formed in base 102. More specifically, as best shown in FIG. 2, a first channel 222 formed in base 102 connects inlet 126 to opening 208 of cavity 202 and opening 212 of cavity 204. In an alternative preferred embodiment best shown in FIG. 10, inlet 126 may be located along the flat side of base 102 between cavities 202, 204. In this alternative preferred embodiment, channel 222 is preferably formed in a "T"-shape with the "vertical" stroke of the "T" extending from the inlet to a point between cavities 202, 204 under fulcrum 104, and the "horizontal" stroke of the "T" extending into cavity 202 at one end and cavity 204 at the other end.

A second channel 224 connects opening 210 of cavity 202 to opening 218 of cavity 206. A third channel 226, connects opening 214 of cavity 204 to opening 216 of cavity 206. Each channel may be lined with PVC pipe or other suitable pipe material. The PVC or other pipe may have a diameter of approximately 1¼ inches. The height of the foundation of base 102 is preferably sufficient to permit the pipe that lines channels 222-226 to be fully embedded within base 102 so as to avoid the potential for puncturing or other damage to the pipe.

As further shown in FIG. 2, cavities 202-206 are provided with respective valve assemblies 228-232. Valve assemblies 228, 230 are the same in structure and operation and will be described jointly. In particular, each of valve assemblies 228, 230 comprises a half-circle rubber flap 234 secured to the floor of its respective cavity 202, 204 by bolts 236 embedded in base 102 and running through holes in rubber flap 234, and fastened respectively by a washer and nut. Rubber flaps 234 are positioned so as to respectively cover openings 208, 212 of cavities 202, 204.

By contrast, valve assembly 232 comprises a full-circle rubber flap 238 secured to the floor of its respective cavity 206 by bolts 240 embedded in base 102 and running through holes in rubber flap 238, and fastened respectively by a washer and nut. Rubber flap 238 is positioned so that a first portion of the flap covers opening 216 of cavity 206, and a second portion of the flap covers opening 218 of cavity 206.

Figure 8:
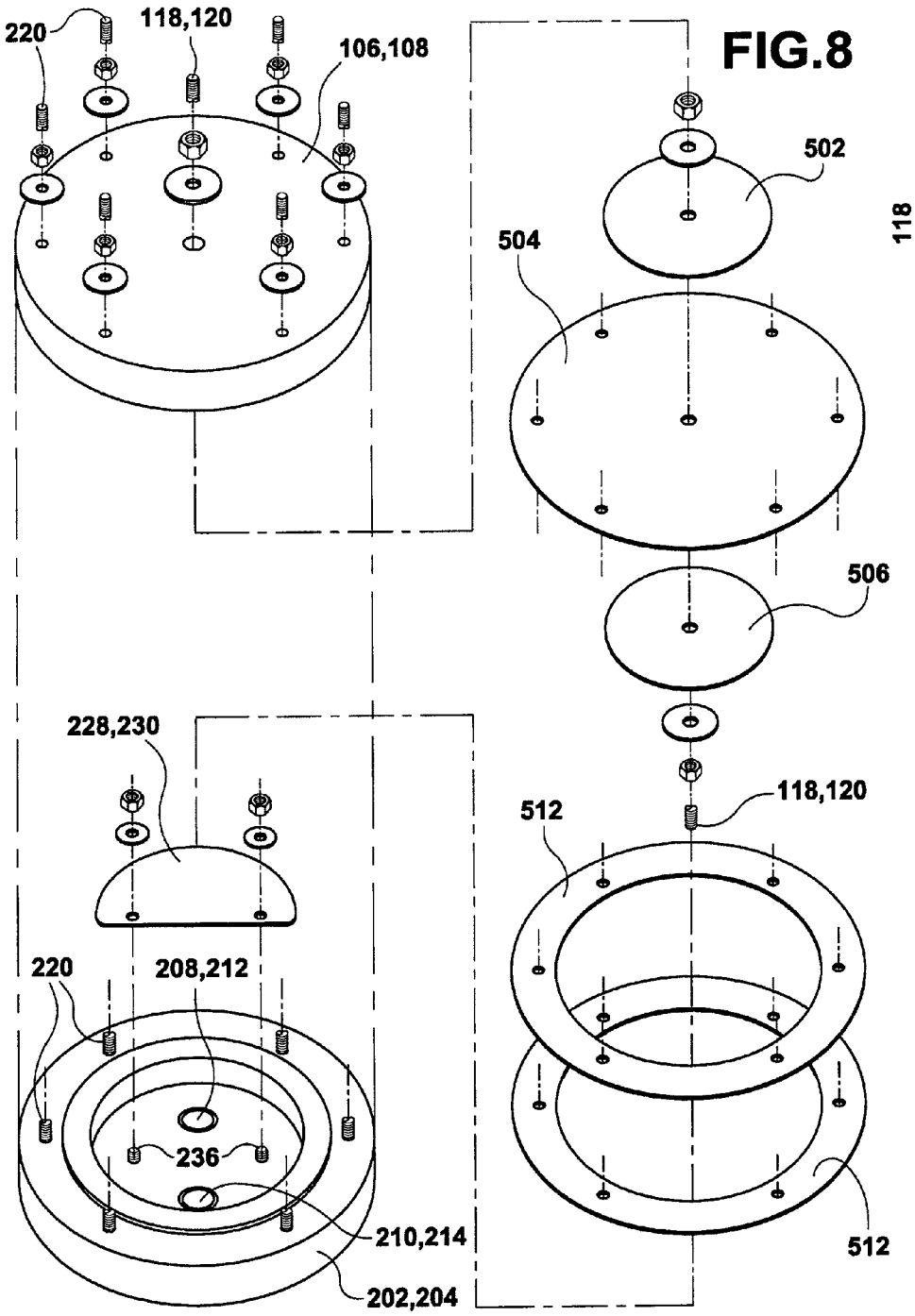
FIG. 8 is an exploded perspective view showing a preferred embodiment of the components of the first two pump chambers of the present invention.

FIG. 8 is an exploded view illustrating components of diaphragm assembly 112 secured between cylinders 106-108 and the shoulders of cavities 202-206. As shown in FIG. 8, each diaphragm assembly 112 comprises a first metal disk 502, a rubber diaphragm 504, and a second metal disk 506. Rubber diaphragm 504 may be a round piece of rubber with a center hole and a plurality of perimeter holes spaced so as to interact with securing bolts 220. Metal disks 502, 506 may also be round and have a diameter smaller than the inner diameter of cavities 202, 204. Each is also provided with a center hole. Rubber diaphragm 504 is held between metal disks 502, 506 by a driving rod 118, 120 fastened with a washer and nut.

Each diaphragm assembly 112 also comprises a seal 512 and preferably two such seals. Each seal 512 may be a round ring of rubber having a width approximately the same as that of the shoulders of cavities 202, 204 and a plurality of perimeter holes spaced so as to interact with securing bolts 220. When assembled, securing bolts 220 pass through seals 512, rubber diaphragm 504, and a cylinder 106, 108 and fastened with washers and nuts.

Figure 9:
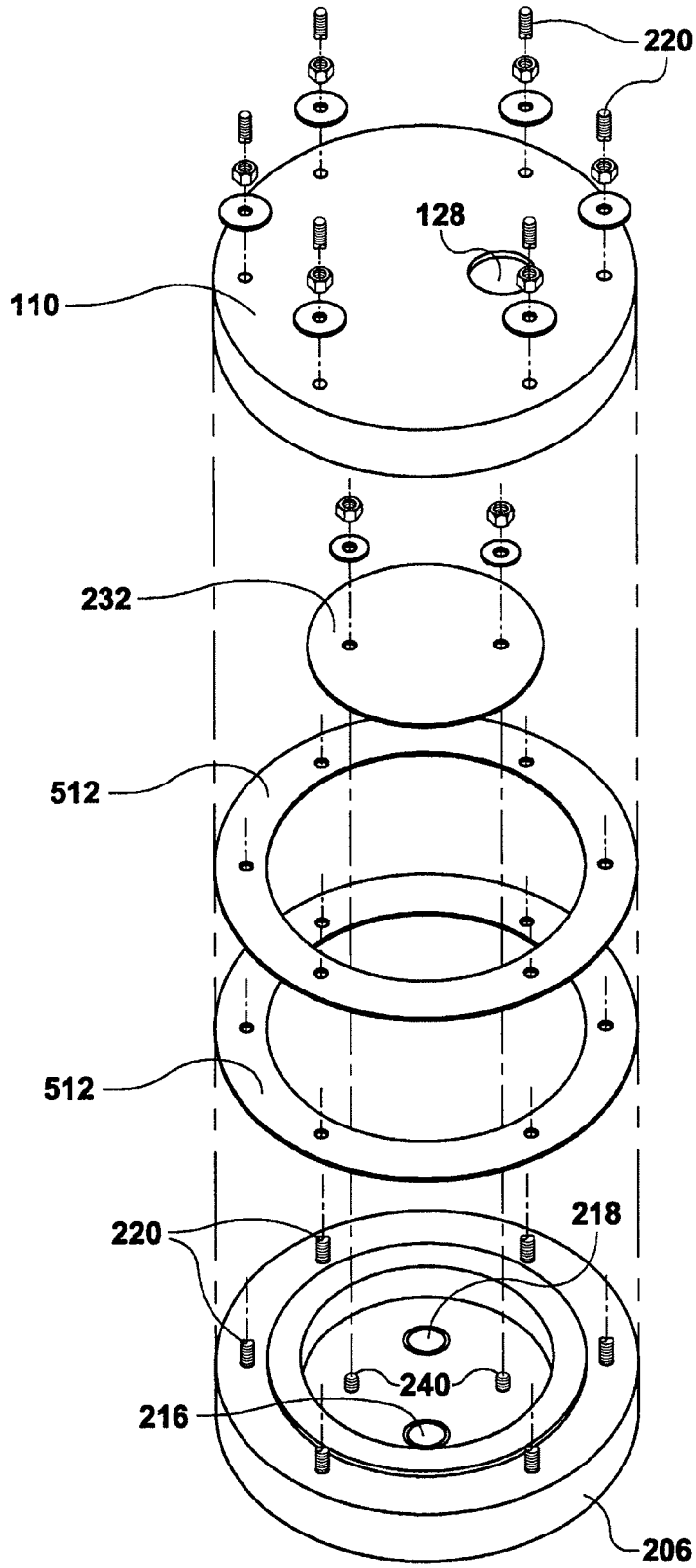
FIG. 9 is an exploded perspective view showing a preferred embodiment of the components of the third pump chamber of the present invention.

FIG. 9 is an exploded view illustrating the manner in which cylinder 110 is secured to the shoulder of cavity 206. As shown in FIG. 9, at least one and preferably two seals 512 are secured between cylinder 110 and the shoulder of cavity 206 by securing bolts 220, washers and nuts.

In operation, a user stands on platform 114 and rocks from side to side causing driving rods 118, 120 to alternately raise and lower diaphragm assemblies 112 in cavities 202, 204. During the period that driving rod 118 is raising the diaphragm assembly of cavity 202, a vacuum is created within the cavity beneath the diaphragm thus causing water to be drawn through inlet 126 and channel 222. This causes the flap of valve assembly 234 to lift permitting the drawn water into the cavity.

While driving rod 118 is being raised, driving rod 120 is simultaneously being lowered, thus depressing diaphragm assembly 112 of cavity 204. During the period that diaphragm assembly 112 is being lowered by driving rod 120, valve assembly 234 is forced closed and seals opening 212, and water in the cavity is forced through channel 226. Pressure from this water causes one flap of valve assembly 238 to open, exposing opening 216 and forcing water from channel 226 into cavity 206.

Conversely, during the period that driving rod 120 is raising diaphragm assembly 112 of cavity 204, a vacuum is created within the cavity beneath the diaphragm thus causing water to be drawn through inlet 126 and channel 222. The pressure from this water flow lifts the flap of valve assembly 234 permitting the drawn water into cavity 204.

While driving rod 120 is being raised, driving rod 118 is simultaneously lowered, thus depressing diaphragm assembly 112 of cavity 202. During the period that diaphragm assembly 112 is being lowered by driving rod 118, valve assembly 234 is forced closed and seals opening 208, and water in the cavity is forced through channel 224. Pressure from this water causes a flap of valve assembly 238 to open, exposing opening 218 and forcing water from channel 224 into cavity 206.

As the process continues and more water is forced into cavity 206 than it can hold, the water collecting in cavity 206 is forced out the top of cylinder 110 through outlet 128 and into hose 124. As will be recognized, water may not exit through outlet 140 immediately when the user begins rocking on platform 118 because it may take several cycles of operation to prime the pump and draw enough water to fill cavity 206.

In a preferred embodiment, pump 100 is constructed completely or as completely as possible from easily available materials and does not require any machining or metal working in its construction. In particular, base 102 of pump 100 may be formed of molded concrete. Channels 222-226 may be created by placing PVC pipe of an appropriate diameter within the mold. The pipe is preferably secured while the concrete is set because it will otherwise float to the surface of the concrete during setting. In one preferred embodiment, the pipe may be secured by placing a wooden frame on top of the mold with wood screws pointing down out of the bottom of the frame and positioned to hold down the pipe while the concrete is setting. Bolts 220, 236, 240 are also secured within the mold such that they will be embedded in base 102 when the concrete poured into the mold hardens. In an alternative embodiment, the base of the pump may be formed from PVC or other suitable material, as shown in FIGS. 10-11.

Cylinders 106-110 may similarly be created from molded concrete using an appropriate mold. Hollow rods may be placed in the mold to form the passages through the cylinders through which securing bolts 220 and driving rods 118, 120 will pass. Alternatively, cylinders 106-110 may be formed of PVC material, as shown in FIGS. 10-11.

Figure 10:
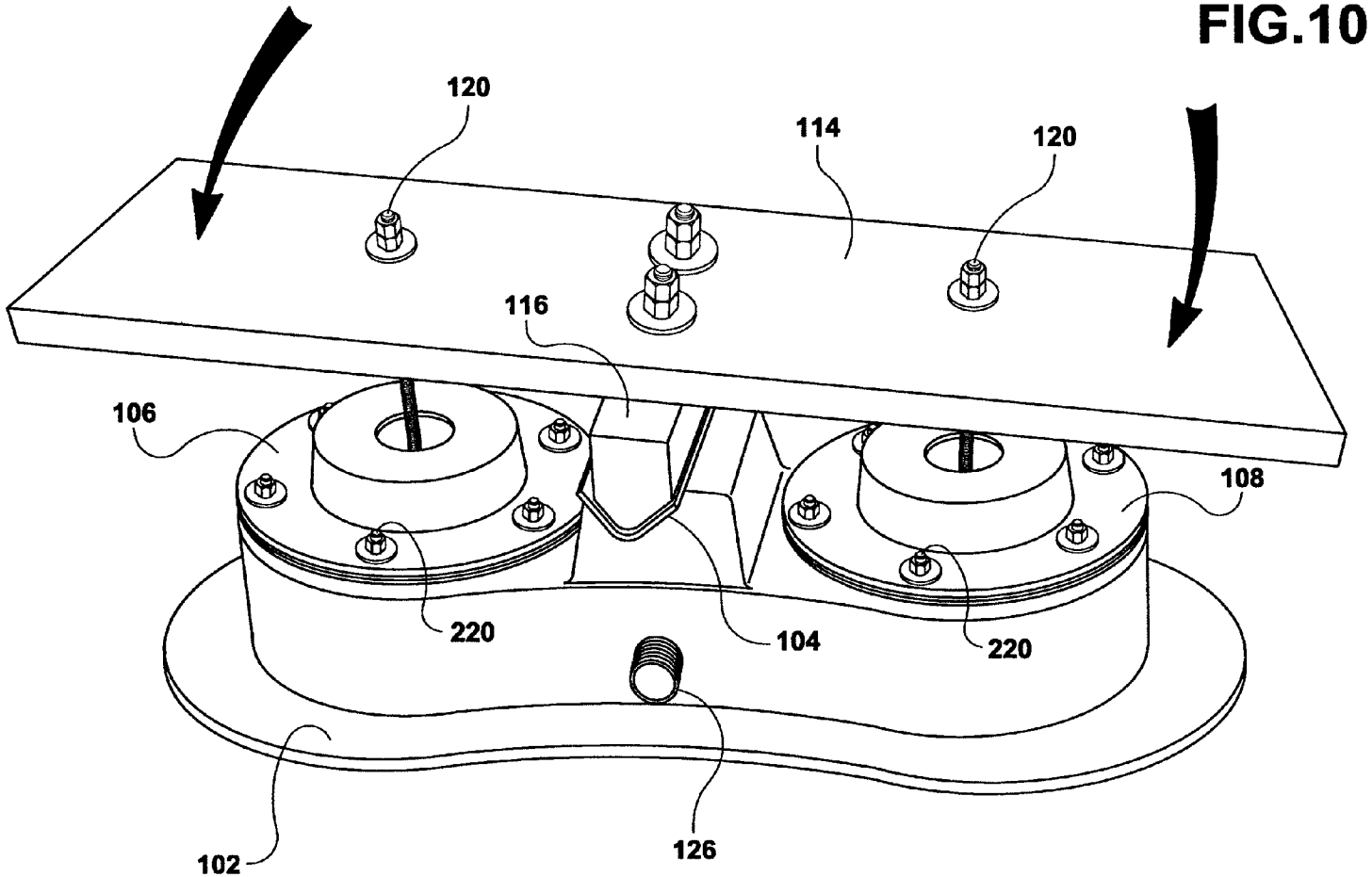
FIG. 10 is a perspective view of a third preferred embodiment of the present invention.
Figure 11:
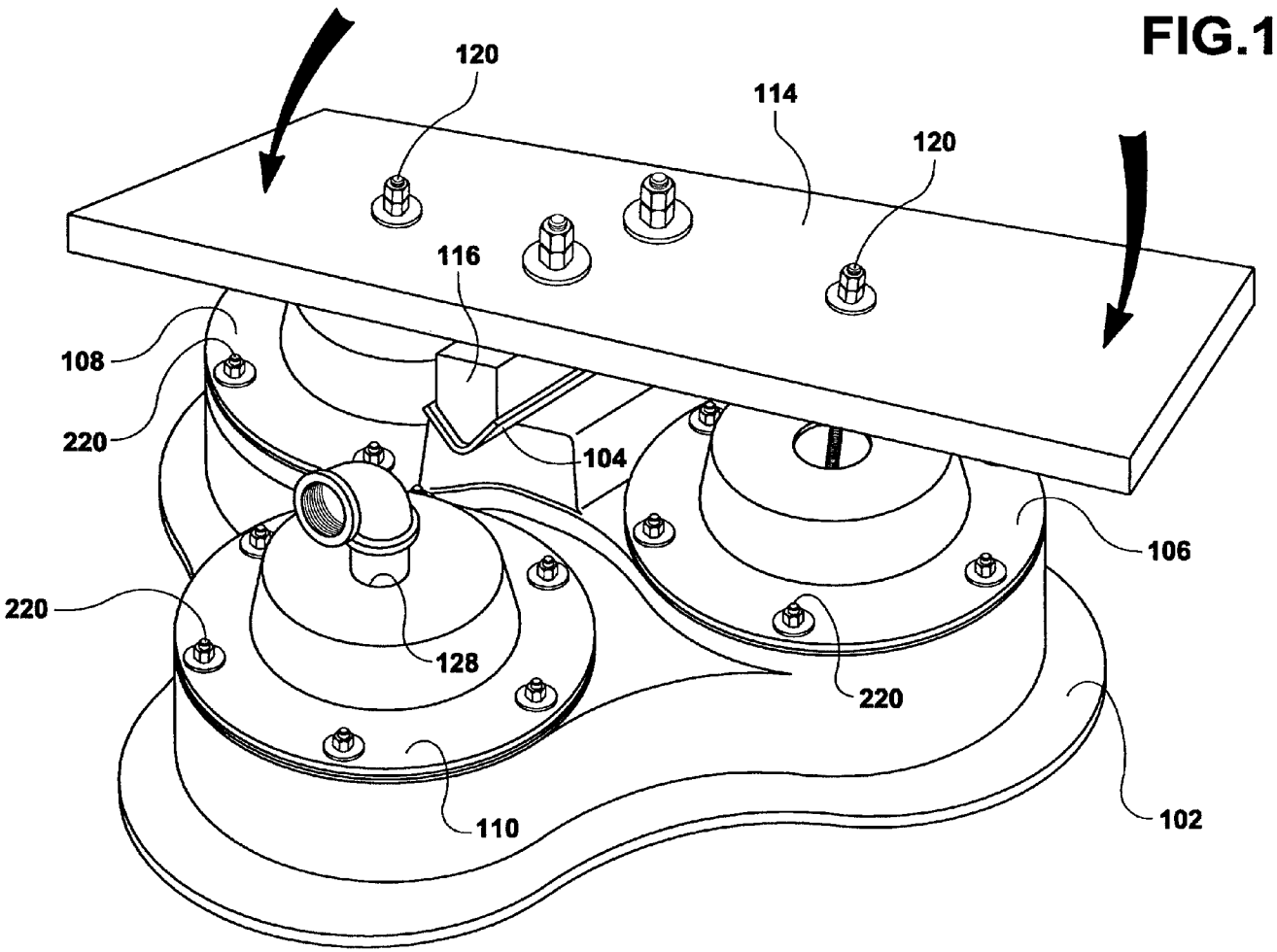
FIG. 11 is a second perspective view of the third preferred embodiment of the present invention.

It should be noted that although FIGS. 1-9 illustrate a pump constructed using a concrete base and concrete cylinders and FIGS. 10-11 illustrate a pump constructed using a PVC base and PVC cylinders, the pump of the present invention may in a preferred embodiment be constructed from mixed materials, e.g., using a concrete base such as shown in FIGS. 1-9, and PVC cylinders, such as shown in FIGS. 10-11. Furthermore, although illustrated as having cylinder like shape in the preferred embodiments of FIGS. 1-9 and having a cylinder like shape with a flat rim in the embodiment shown in FIGS. 10-11, components 106-110 may be formed in other shapes if desired.

Diaphragm 504, seals 512, and valve flaps 234, 238 may all be constructed from rubber material and preferably from the inner tubes of tires, a commonly available source of rubber in many underdeveloped areas of the world. PVC pipe and the various bolts, washers, nuts, rectangular brackets, and circular disks used to construct pump 100 are all common hardware items typically available even in underdeveloped areas. Platform 114 may be constructed from any type of available wood.

Figure 6:
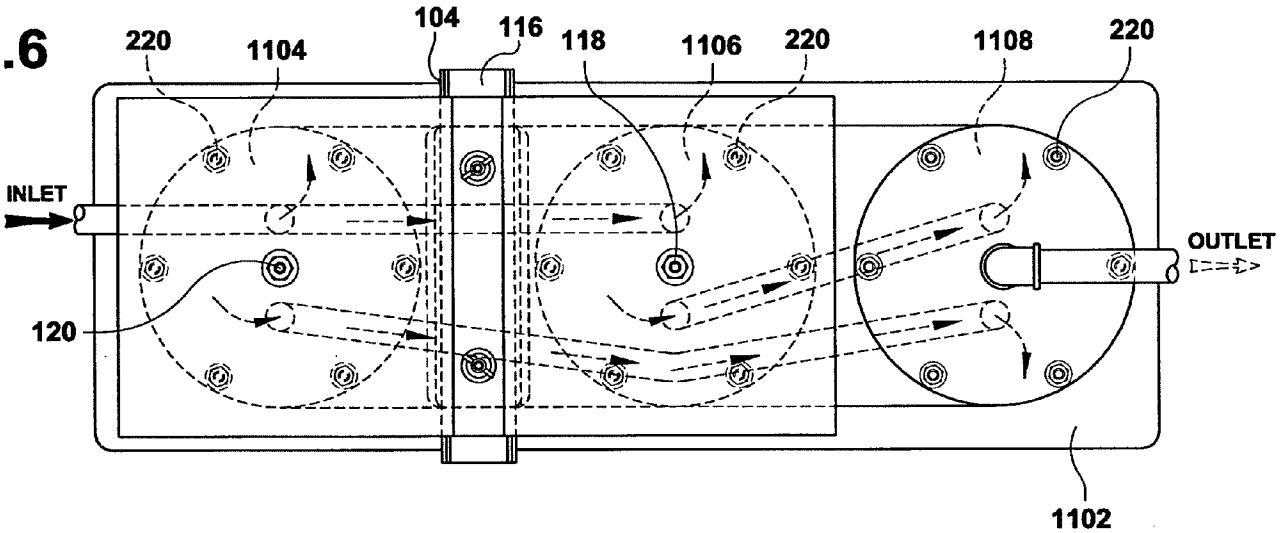
FIG. 6 is a top plan view of a second preferred embodiment of the present invention.
Figure 7:
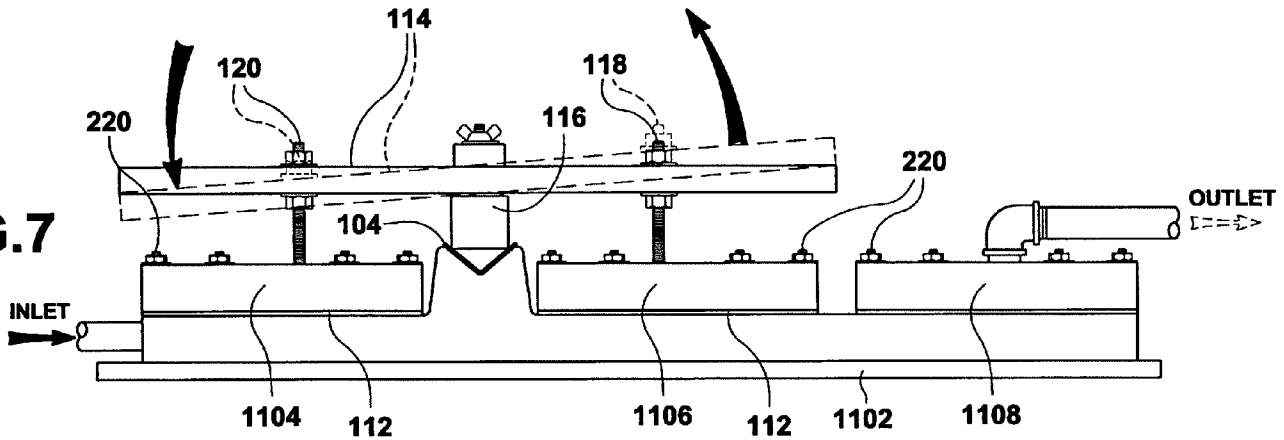
FIG. 7 is a front elevation view of the preferred embodiment of FIG. 6.

An alternative embodiment of the present invention is shown in FIGS. 6-7 in which the base 1102 is generally rectangular in shape and chambers 1104-1108 are oriented generally in a straight line. In this alternative embodiment, chamber 1104 performs the role of chamber 202 of FIG. 2 and is provided with an appropriate valve assembly 234 and diaphragm assembly 112. Chamber 1106 performs the role of chamber 204 of FIG. 2 and is provided with an appropriate valve assembly 234 and diaphragm assembly 112. Chamber 1108 performs the role of chamber 206 of FIG. 2 and is provided with an appropriate valve 238 and seal 512.

As shown in FIG. 6, in this alternative embodiment, chambers 1104-1108 are connected via channels formed in base 1102 analogous to those described above in connection with the embodiment of FIG. 2. As above, each channel may be lined with PVC pipe or other suitable pipe material.

Although the present disclosure has been described in relation to particular embodiments, many other variations, modifications, and other use of the present invention will be apparent to those skilled in the art. Accordingly, the scope of the present invention should be limited not by the specific disclosure herein, but only by the appended claims.

The invention claimed is;

1. A pump, comprising:

(a) a molded concrete base, said molded concrete base having formed therein:
  (i) first, second, and third lower cavities; and
  (ii) a fulcrum;
  said molded concrete base having embedded therein:
  (i) a first pipe having first and second outlets connecting respectively to said first and second lower cavities;
  (ii) a second pipe having an inlet for connecting to said first lower cavity and an outlet for connecting to said third lower cavity; and
  (iii) a third pipe having an inlet for connecting to said second lower cavity and an outlet for connecting to said third lower cavity;

(b) first and second single valves secured respectively to the first and second lower cavities for selectively opening and closing the first and second outlets of said first pipe during alternate half cycles of said pump;

(c) a double valve secured to the third lower cavity for selectively opening and closing the outlet of said second pipe and the outlet of said third pipe during alternate half cycles of said pump;

(d) first, second, and third top portions;

(e) first and second diaphragms, said first diaphragm being secured between said first top portion and said concrete base and said second diaphragm being secured between said second top portion and said concrete base;

(f) an output chamber formed by securing the third top portion to the third lower cavity, said output chamber having an outlet;

(g) a pumping platform, said pumping platform, comprising:
  (i) a pivot for engaging the fulcrum of the concrete base; and
  (ii) a lever having first and second portions extending respectively to either side of said pivot; and (h) first and second driving rods, the first driving rod being secured to the first portion of said lever and to the first diaphragm, and the second driving rod being secured to the second portion of the lever and to the second diaphragm.

2. The pump of claim 1, wherein each of said first, second, and third concrete top portion is a concrete cylinder having formed in the underside thereof an upper cavity.

3. The pump of claim 2, wherein each of the first and second concrete cylinders has a hole through the top thereof proximate to the center of said concrete cylinders.

4. The pump of claim 1, further comprising at least a first, second, and third seals each being secured respectively between each of said first, second, and third concrete cylinders and the concrete base.

5. The pump of claim 1, wherein each of the first and second single valves, the double valve, the first and second diaphragms, the first, second, and third concrete cylinders, the first and second driving rods, and the first and second portions of the lever are secured by a first nut and washer.

6. The pump of claim 1, wherein each of said first and second diaphragms are held between a first and second metal disk and the first and second metal disks are secured by a first and second nut and washer.

7. The pump of claim 1, wherein a first hose is connected to an inlet of said first embedded pipe.

8. The pump of claim 1, wherein a second hose is connected to said third top portion.

9. The pump of claim 1, wherein the concrete base has embedded therein a first plurality of securing bolts arranged in a circle proximate to the rim of said first lower cavity, a second plurality of securing bolts arranged in a circle proximate to the rim of said second lower cavity, and a third plurality of securing bolts arranged in a circle proximate to the rim of said third lower cavity and each said first, second, and third top portion has holes formed around the perimeter thereof for engaging said first, second, and third plurality of securing bolts.

10. The pump of claim 1, wherein the concrete base has embedded therein first bolts in the first lower cavity, second bolts in the second lower cavity, and third bolts in the third lower cavity, and the first single valve is secured to said first bolts so as to selectively seal said first outlet of said first pipe during alternate half cycles of said pump, the second single valve is secured to said second bolts so as to selectively seal said second outlet of said first pipe during alternate half cycles of said pump, and the double valve is secured to said third bolts so as to selectively seal the opening of either the outlet of said second pipe or the outlet of said third pipe during alternate half cycles of said pump.

11. The pump of claim 1, wherein none of the lower cavities or cylinders are formed of machined parts.

12. The pump of claim 1, wherein the material being pumped is water.

13. A pump, comprising:

(a) three concrete chambers;

(b) a pumping platform adapted to rock in a see-saw fashion;

(c) the first and second of said chambers being provided with diaphragms adapted to be displaced from their rest positions by said rocking motion of said pumping platform and, as a result of said rocking of said pumping platform, to:

(i) draw liquid into said first and second chambers respectively, and (ii) force liquid from said first and second chambers respectively into said third chamber;

(d) first and second valves adapted to allow a liquid to respectively enter the first and second chambers from a source outside the chambers through first and second openings in said chambers, but to prevent the liquid from exiting the first and second chambers through said first and second openings; and (e) third and fourth valves adapted to respectively allow liquid to flow from the first and second chambers into the third chamber, but prevent the liquid in the third chamber from flowing into either the first or second chamber.

14. The pump of claim 13, wherein the liquid being pumped is water.

15. The pump of claim 13, wherein the first valve is located in the first chamber, the second valve is located within the second chamber, and the third and fourth valves are located within the third chamber.

* * * * *